United States Patent [19]

Hawkins et al.

[11] Patent Number: 4,858,771

[45] Date of Patent: Aug. 22, 1989

[54] PARTICLE DISTRIBUTING AND SORTING METHOD AND APPARATUS

[75] Inventors: Albert P. Hawkins; Alan Boyle; Alan M. Stone, all of Melbourne, Australia

[73] Assignee: Argyle Diamond Mines Pty. Limited, West Perth, Australia

[21] Appl. No.: 520,125

[22] Filed: Aug. 3, 1983

[30] Foreign Application Priority Data

Aug. 4, 1982 [AU] Australia ..... PF5199

[51] Int. Cl.[4] ..... B07C 5/36

[52] U.S. Cl. ..... 209/552; 209/589; 209/908; 209/920; 221/203; 239/659

[58] Field of Search ..... 209/552, 589, 908, 910, 209/911, 920, 922; 239/659, 102; 221/203, 200, 156, 277; 222/196, 199, 200

[56] References Cited

U.S. PATENT DOCUMENTS

| | | | |
|---|---|---|---|
| 2,969,987 | 1/1961 | DeBiasi | 239/659 |
| 3,009,571 | 11/1961 | Roberts, Jr. | 209/908 |
| 4,126,226 | 11/1978 | Bello et al. | 209/589 |
| 4,361,254 | 11/1982 | Teraoku et al. | 222/196 |
| 4,470,524 | 9/1984 | Semenenko | 222/196 |

FOREIGN PATENT DOCUMENTS

| | | | |
|---|---|---|---|
| 144377 | 4/1961 | U.S.S.R. | 222/196 |
| 846284 | 7/1981 | U.S.S.R. | 222/196 |
| 787730 | 12/1957 | United Kingdom | 239/659 |
| 1581929 | 12/1980 | United Kingdom | 239/659 |

*Primary Examiner*—Johnny D. Cherry
*Assistant Examiner*—Donald T. Hajec
*Attorney, Agent, or Firm*—Cushman, Darby & Cushman

[57] ABSTRACT

Particles are fed for sorting by a radial distributor having an upper surface on which the particles gradually spread arcuately and are displaced radially outwardly, by for example vibration of the distributor, to a lip of the upper surface where they define one or more curved arrays as the fall over the lip. As they fall in free flight trajectory paths the particles present a curved array one particle deep to a separating device arranged to sort the particles according to the degree they possess a particular characteristic.

11 Claims, 4 Drawing Sheets

PARTICLE DISTRIBUTING AND SORTING METHOD AND APPARATUS

This invention relates to methods and apparatus for automatically sorting particulate material especially, but not exclusively, small sized particles on a particle-by-particle basis at high throughputs, and is particularly concerned with feeding the particulate material for sorting.

In existing automatic sorting machines, the particles to be sorted are projected in free flight trajectory and selected particles are deflected by blasts of fluid, generally air blasts, by the operation of electrically controlled blast valves. The deflected particles are separated from the undeflected particles by a fixed splitter plate located downstream from the blast zone. The particles are usually projected in a narrow band of adjacent streams each presenting particles one-by-one to a detector and to the fluid blast zone.

The existing machines have severe limitations when it is necessary to treat large numbers of particles on close to a one-by-one basis down to small particle size. In some plants, the material to be sorted is upgraded by feeding low tonnages per unit time to each of several machines, blasting a comparatively large number of undesired particles for each desired particle, and repeating this process by resorting the accepted material a sufficient number of times to produce eventually an acceptable product grade. To increase plant capacity with conventional equipment, several banks of machines treating identical feed in parallel may be required, but if each machine incorporates expensive feed and detection equipment, it is important to minimize the number used to do a given task.

It has also been proposed to separate particulate material electrically. According to one such proposal, all particles passing through an electrical charging field are charged according to their electrical surface conductivity. The success of such separation is dependent on sufficient differential electrical surface conductivity of the particular particulate material to be separated. Thus, charge applied to particles passing through the electric field is more mobile on more conductive material and hence able to discharge more fully onto a counter electrode brought into contact with part of the particle surface. However, such differential surface effects are extremely prone to masking by, for example, moisture or other surface contamination as well as by the shadow of other particles, and it is often the case that significant proportions of waste have similar electrical conduction properties to the particulate material to be separated so that separation by this method may not be successful.

The problem of sorting desired from undesired particles whilst diluting the accepted product with as few undesired species as possible and at the same time taking care not to leave any desired particles undeflected, becomes an increasingly difficult task as the size of the objects is decreased and the number of such particles per unit time increases, but the problem may be reduced by efficiently exposing the particulate material to the sorting apparatus.

One further proposal for sorting particulate material is in the form of apparatus in which particles in a free flight trajectory path are deflected according to the degree to which they possess a certain characteristic where the particle deflection means comprises electrostatic means capable of being triggered to selectively choose those particles having the certain characteristic and an electric field generator to establish an electric field effective to deflect the charged particles.

The certain characteristic of the particles to be separated may comprise, for example, one or more of the selective emission or reflection of electromagnetic radiation, the ability to attenuate the passage of electromagnetic radiation, different electrical conductivity or magnetic susceptibility, and the sorting apparatus may include detection means adapted to determine such characteristic, and control means actuatable on receipt by said detection means of a signal identifying such characteristic to trigger the electrostatic means and charge the particle or particles having the characteristic. Advantageously a source of electromagnetic radiation may be provided to identify the certain characteristic. Thus, in the case where the certain characteristic is a particular electrical conductivity or magnetic susceptibility, a radiation field may be provided which is disturbed in a predetermined manner by the passage therethrough of particles having the characteristic.

In one embodiment of such sorting apparatus for use in detecting diamonds, the particles may pass through an x-ray beam which will produce fluorescent response in any diamonds present. Such fluorescent response may be detected in the irradiation zone by a photomultiplier based or microchannel plate intensified detection system.

Said one further proposal for sorting particulate material is described in greater detail and is claimed in our copending application entitled "Particle Sorting Method and Apparatus" which is incorporated herein by reference and from which it will be appreciated that the apparatus operates at optimum efficiency by exposing a large number of particles simultaneously to the deflection means, and to the detection means.

It is an object of the present invention to provide sorting apparatus in which particulate material may be efficiently exposed for sorting.

In accordance with the present invention, sorting apparatus is provided comprising particle feed means capable of feeding particles to be sorted in paths which radiate out from a central zone of the apparatus and downwardly in an array curved about the central zone; and means to separate the particles into fractions according to the degree to which they possess a particular characteristic as they fall in said curved array of paths around the central zone.

The particle feed means may comprise a source, such as a feed hopper, for the particles to be sorted and a radial distributor disposed to receive the particles therefrom and to distribute them radially outwardly in said paths.

Such a radial distributor may have a generally conical upwardly facing surface and the particles may be fed from the centre to the edge of that surface by gravity and/or vibration substantially in the radial plane.

The radial distributor may be such that the particles fall substantially vertically therefrom in one or more circumferentially spaced paths curved in a cylindrical array about the central zone.

According to a preferred embodiment the sorting apparatus includes means for controlling outflow of the particulate material from the source and for feeding the particulate material to the radial distributor in an array corresponding to said curved array.

The radial distributor preferably distributes the particles in a uniform and symmetrical manner corresponding to the curved array whereby at suitable particle feed rates, a bed of particles several deep at the centre of the radial distributor is gradually displaced radially outwardly to define the curved array. When the particles reach the edge of the radial distributor defining the curved array they advantageously fall under the action of gravity from an essentially zero vertical velocity, whereby they are dispersed uniformly about the curved array.

The apparatus in accordance with the present invention may comprise detector means responsive to a certain characteristic of the particles moving in said paths in a curved or annular detection zone and adapted to trigger the selecting means to select the detected particle or particles. The detector means may, for example, be comprised of a series of detectors arranged in a curved or annular array around the detection zone. Alternatively, the detector means could comprise a detector allied with scanning means to scan the curved or annular detection zone.

Associated with the detector means there may be irradiating means to irradiate the particles with some form of electromagnetic energy to produce or enhance the characteristic to be detected by the detector means. For example selective reflection of electromagnetic radiation or x-ray fluorescence may be used as the basis of sorting. In such cases the irradiating means may be a source of radiation disposed in the central zone of the apparatus and arranged to radiate outwardly and around the detection zone.

The separating means of the apparatus in accordance with the present invention may comprise a correspondingly curved or cylindrical array of blast valves, in which case the certain characteristic may be mass and/or particle size, or any other suitable deflection mechanism. Such blast valves or other deflection mechanism may be triggered by the aforementioned detection means detecting, for example, fluorescence or surface electrical conductivity. Preferably the distributing separating means is utilized with the separating apparatus disclosed in our aforementioned copending application, with the electrostatic means, the electric field generator and the detecting means thereof all operating in or around the curved or cylindrical array.

The present invention further provides a sorting method comprising:

feeding particles to be sorted in paths which radiate out from a central zone and downwardly in an array curved about the central zone, detecting the degree to which the particles possess a particular characteristic as they fall in said curved array of paths around the central zone, and separating the particles into fractions according to the determination of the degree to which they possess said characteristic.

In order that the invention may be more fully explained, one embodiment of apparatus and method in accordance with the invention will now be described by way of example only with reference to the accompanying drawings in which:

FIG. 7 is an enlarged view of a second embodiment of the distributor.

Figure 1:
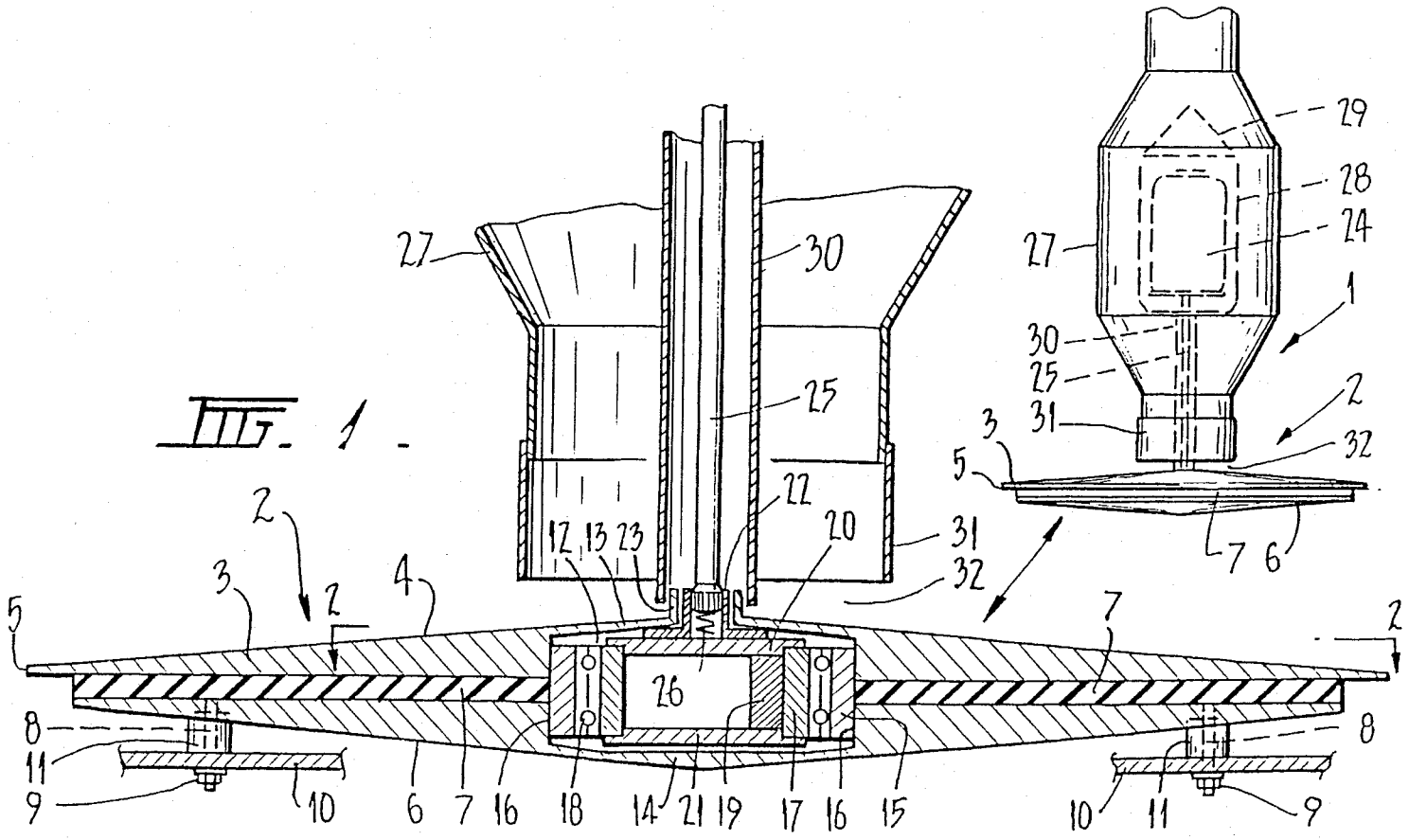
FIG. 1 is a vertical sectional view of feed means for use with apparatus in accordance with the present invention.
Figure 2:
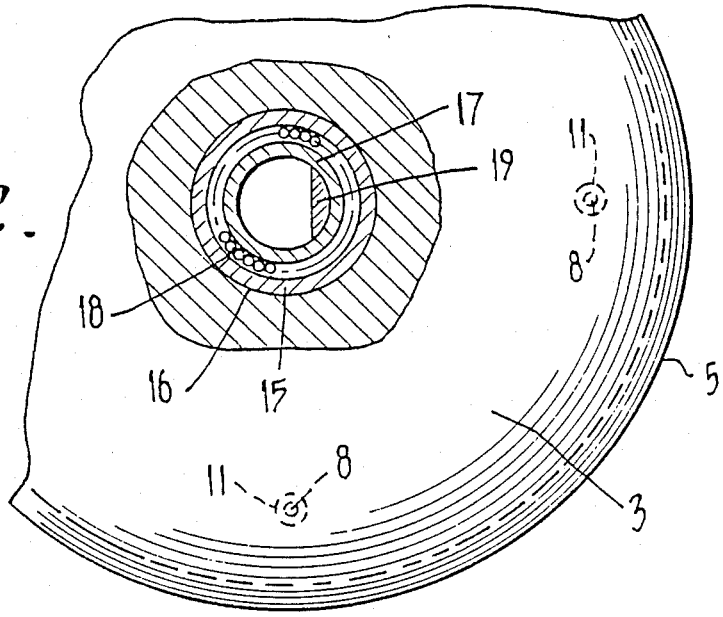
FIG. 2 is a cross-sectional view taken on line 2—2 of FIG. 1.
Figure 5:
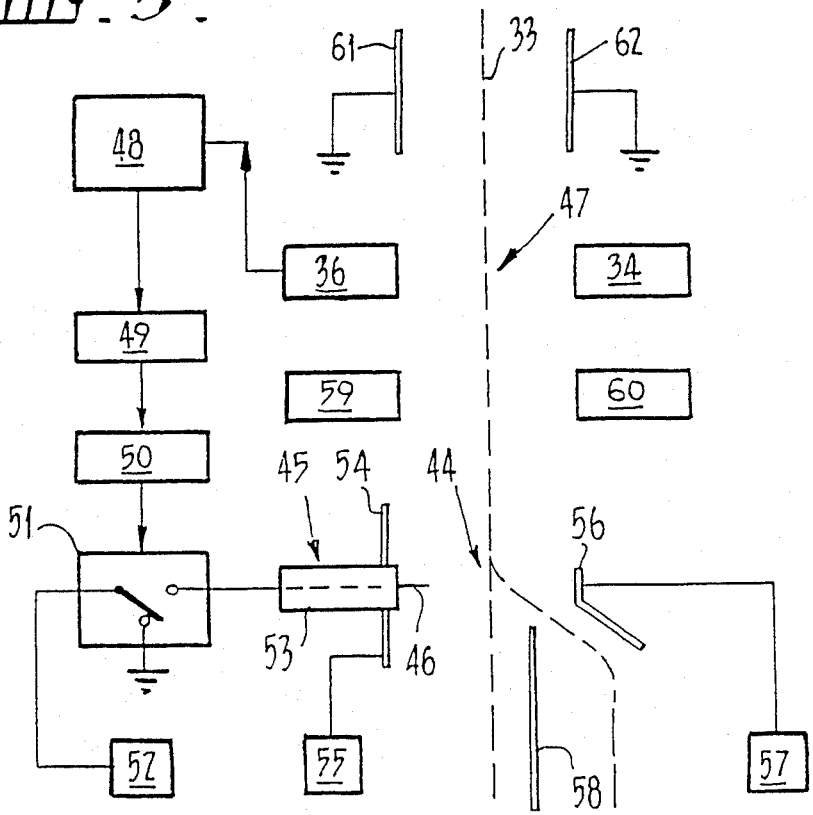
FIG. 5 is a highly diagrammatic cross-section detailing the operation of the separating means in FIG. 3.
Figure 3:
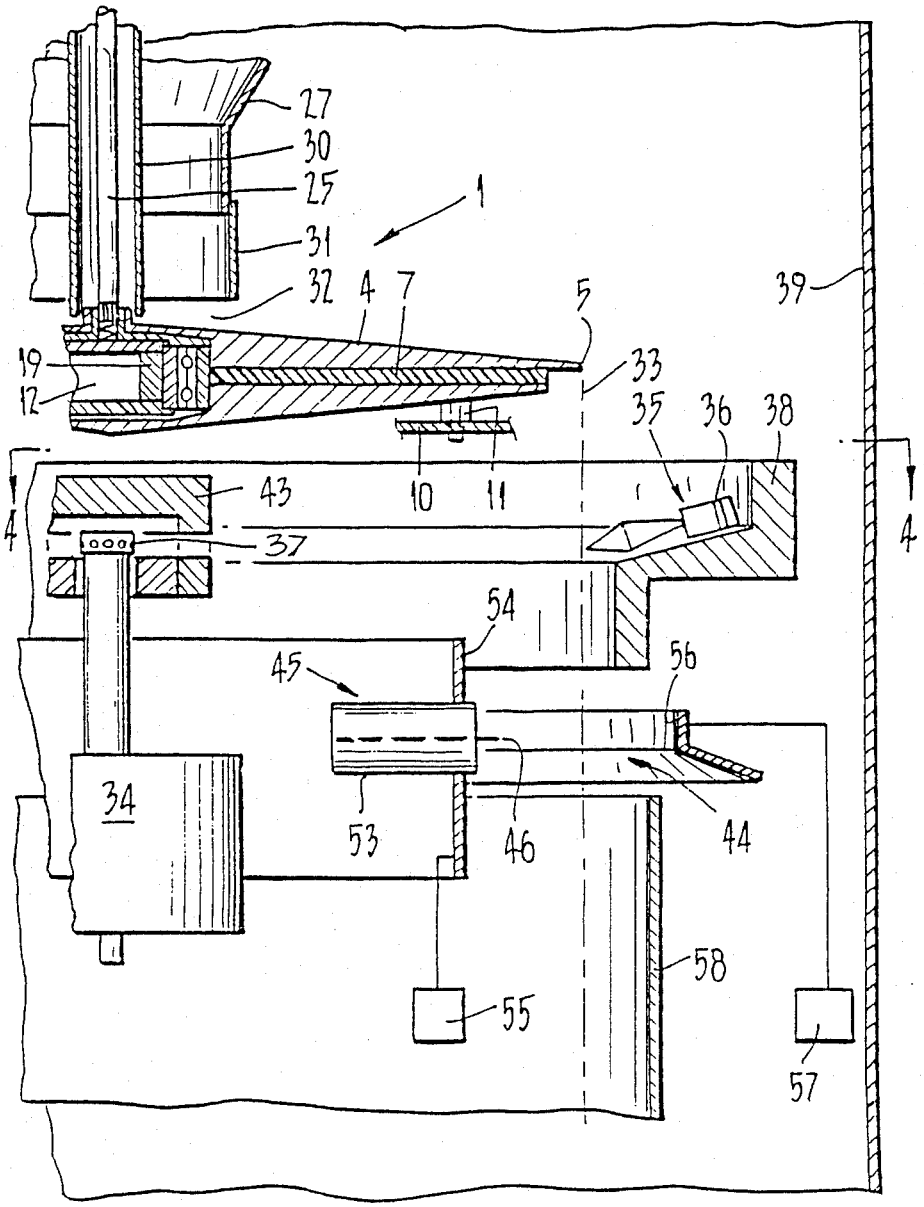
FIG. 3 is a half-sectional view of the one embodiment of sorting apparatus including the feed means of FIGS. 1 and 2.
Figure 4:
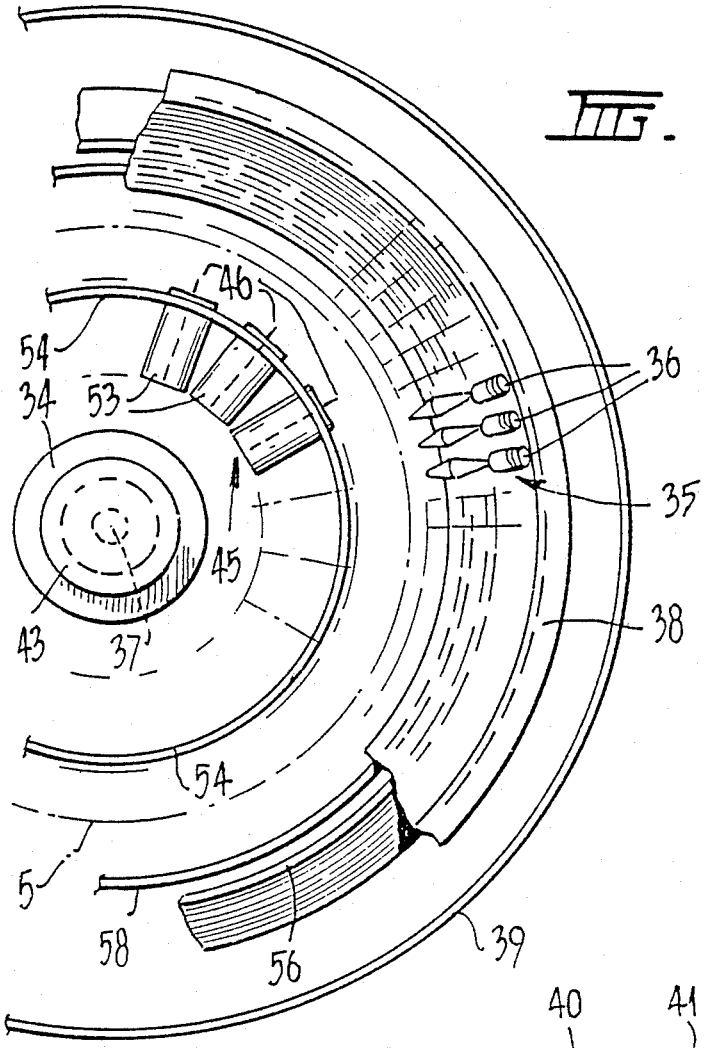
FIG. 4 is a partial plan view taken on the line 4—4 of FIG. 3.

Referring to FIGS. 1 and 2, there is shown feed means 1 which is adapted to present a cylindrical array of particles to particle selection means located beneath the feed means. The feed means 1 is illustrated in FIGS. 3 to 5 in use with one particular form of particle selection means which will be described in greater detail hereinafter but which is described and claimed in our copending application entitled "Particle Sorting Method and Apparatus".

Feed means 1 includes a radial distributor 2 comprising a circular plate 3 having an upwardly conical upper surface 4. As illustrated, the upper surface extends at about 5° to the radial plane, but it may extend at an angle of up to about 15° to said plane. Furthermore, the upper surface 4 may extend at an angle of less than 5° and may be flat (i.e. at 0°). The shallow cone angle permits good particle control in displacing the particles from the centre of the plate 3 to the annular rim 5 thereof. The distributor plate 3 is preferably formed of stainless steel. The diameter of the distributor plate 3 is typically in the range 200 to 2,000 mm.

The radial distributor 2 further comprises an inverted conical balance plate 6, preferably of mild steel, of slightly less diameter than that of the distributor plate 3. A damping material 7 of the same diameter as the balance plate 6 is sandwiched between the balance plate and the distributor plate 3. The damping material may comprise rubber or any other suitable polymeric material and the distributor and balance plates 3 and 6 are bonded to it to form an integral unit. The balance plate 6 has four equally circumferentially spaced studs 8 (only two shown) projecting downwardly therefrom which are secured by means of a screw-threaded nut 9 to a rigid frame 10 of the apparatus. Each stud 8 carries a vibration isolating mounting member 11 between the plate 6 and frame 10 to permit vibration of the radial distributor 2 relative to the frame 10.

The studs 8 and screw-threaded nuts 9 also provide vertical adjustment of the radial distributor 2 to ensure that it extends in a horizontal plane. It is well known that such adjustment is facilitated by the provision of only three equally spaced adjustable mountings and such a modification may be made if desired. Furthermore, the mountings 11 may extend from the upper surface 4 of plate 3 in order to suspend the radial distributor 2 rather than support it as shown. It is believed that the provision of mountings projecting from the upper surface 4 will not substantially affect the flow of particles from the radial distributor.

The distributor plate 3, balance plate 6 and sandwiched damping material 7 together define an essentially cylindrical hollow centre portion 12 of the radial distributor 12, which is closed at each axial end by respective overlapping portions 13 and 14 of the plates 3 and 6. A ball bearing outer race 15 is securely mounted on the cylindrical wall 16 of the hollow centred portion 12. The ball bearing outer race 15 carries for rotation relative thereto a bearing inner race 17 supported by balls 18. The inner race 17 carries on its radially inner surface an eccentric weight 19 (seen most clearly in FIG. 2) which is rotationally secured relative to the inner race 17. The inner race 17 also carries upper and lower end plates 20 and 21, the upper end plate 20 fixedly supporting on its upper surface a keyed sleeve 22 which is rotatable with the inner race 17 relative to an upturned part 23 of the overlapping portion 13. The sleeve 22, inner race 17 and outer race 16 are provided on the axis of the radial distributor 2 and a variable speed drive motor 24 is supported by means (not shown) axially above the radial distributor 2, a drive shaft 25 extending axially from the drive motor 24 being keyed with the sleeve 22 to rotate the inner race 17 and eccentric weight 19. The drive shaft 25 is supported relative to the upper end plate 20 by means of a coil or other compression spring 26.

Rotation of the inner race 17 and eccentric weight 19 relative to the radial distributor 2 creates vibration of the radial distributor in the plane of rotation of the weight which, as shown, is horizontal. The vibration causes the particles at the centre of the upper surface 4 of the distributor plate 3 to gradually be displaced outwardly in radial paths until they drop off the rim 5 of the distributor plate in a stream or streams defined by said radial paths. The vibration may be varied by adjusting the speed of rotation of the drive motor or by adjusting the radial spacing of the eccentric weight 19.

Particles, including waste particles and the particles to be selected are fed to the upper surface 4 of the distributor plate 3 from a hopper 27 in which the motor 24 is located. The motor 24 is protected from the particles by a housing 28 having a conical upper end 29 which is adapted to deflect particles falling onto it. The drive shaft 25 is protected from the particles by a cylindrical casing 30 which extends from the housing 28 to surround the upturned part 23 of the overlapping portion 13. The outlet 32 from the hopper 27 is defined between the upper surface 4 of the distributor plate 3 and an annular slide plate 31 which may be moved up and down relative to the hopper and to the upper surface 4 in order to vary the height of the annular outlet 32. The slide plate 31 may be automatically adjusted through a pneumatic actuator (not shown) to choke the flow of particles so that the feed hopper 27 can be operated at a uniform flow rate for minimization of dilution over a required unit period of operation. The annular outlet 32 will typically have a gap variable between 5 and 25 mm, the preferred size of which will primarily depend upon the particle size. Means (not shown) may be provided to ensure that the particles pass through the outlet 32 from the hopper uniformly around the outlet. From a deep layer at and around the centre of the upper surface 4, the particles fed from the hopper 27 are induced to work their way to the rim 5 of the distributor plate 3 as they are forced radially outwardly by the vibrator action. The particles may form an essentially randomly streamed mono-layer at the rim 5 prior to being edged over the rim to fall in an essentially annular stream 33 (see FIG. 3), accelerating from substantially zero vertical velocity freely under gravity. In accelerating, the annular array of particles tend to separate vertically from each other allowing clearer detection and deflection.

The use of the feed means described with reference to FIGS. 1 and 2 with selection means particularly designed for sorting of diamonds from accompanying particulate waste material, in particular diamonds at sizes of around 0.5 to 3 mm square mesh, will now be described with reference to FIGS. 3 to 6 using an x-ray detection system and an electrostatic charging particle deflection system. However, it will be appreciated that the feed means may be used with many other forms of selection apparatus.

Figure 6:
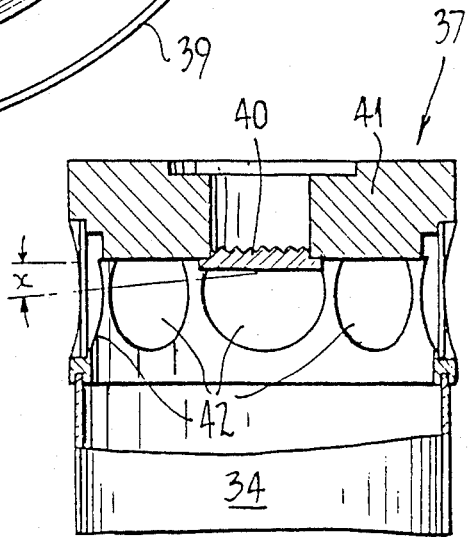
FIG. 6 is an enlarged view, partly in cross-section, of part of the sorting apparatus in FIG. 3.

After falling typically 150 mm, the particles in the annular stream 33 pass an x-ray beam generated by an essentially panoramic x-ray tube 34. Fluorescence from diamonds in the stream 33 irradiated by the panoramic x-ray beam is picked up by the adjacent one of an annular array 35 of photomultiplier tubes 36 which extends around the x-ray tube at a level with the x-ray emitting end 37 of the tube. The annular array 35 may comprise for example thirty-two photomultiplier tubes 36 (only three are shown in FIG. 4) so that each photomultiplier is intended to detect fluorescence in diamonds in 1/32 of the stream 33 of falling particles, the array 35 of photomultiplier tubes being located radially outwardly of said stream and the x-ray tube 34 being located on the axis of the annular stream 33 and feed means 1. The array 35 of photomultiplier tubes 36 has an annular lead shield 38 extending thereabout to limit the passage of the x-ray beam, and the whole sorting apparatus is located in a cylindrical housing 39 which may also be lead lined. The x-ray tube 34 may be a defraction tube modified at its emitting end 37 substantially as shown in FIG. 6 to simulate a panoramic (360°) tube. Electrons emitted by a suitable cathode (not shown) in the tube 34 bombard a plate-like copper anode 40 (or any other suitable anode) supported on an annular lead end piece 41. The emitting end 37 of the tube is provided with an annular array of eight circular beryllium windows 42 which are level with the copper anode 40. Each beryllium window has a diameter of approximately 20 mm and a thickness of the order of 300 microns. The electrons bombarding the copper anode cause the anode to give off x-rays homogeneously and, although the eight beryllium windows do not permit the passage of the x-rays entirely homogeneously around the full 360°, the x-rays will form a continuous beam at a short radius from the tube, normally at about 150 mm from the tube axis, due to overlap of the beams from neighbouring windows. The beam may be confined to a radial 360° wedge of the desired take off angle x, preferably of the order of 6°, by the use of a lead collimator 43 (see FIG. 3) having an annular window extending therethrough at the level of the end portion 37 and photomultiplier tubes 36.

Each photomultiplier tube 36 may have individual light gathering optics and detectors to improve signal to noise performance from weak signals due to small sized diamonds passing in front of the photomultiplier. An alternative to the use of an array 35 of segmented photomultiplier tubes would be to use a single photomultiplier tube and a centrally mounted high speed rotating prism which sweeps the 360° field at a rate and with an instantaneous field of view which would ensure that no particles with fluorescent outputs are missed and passed undetected.

As close to the actual detection zone as practical, the annular array 33 of particles, which are advantageously dried prior to entry into the hopper 27, is selectively charged by use of annular corona discharge apparatus 44. Typically, the corona discharge apparatus 44 may comprise thirty-two corona discharge segments 45 (only three are shown in FIG. 4) defining the annulus each with at least one discharge point 46 (only one shown) corresponding to the position of a respective photomultiplier tube 36. Accordingly, one corona discharge segment 45 is actuated, after a suitable delay, when the photomultiplier tube 36 in the same radial plane picks up fluorescence from a particle passing through the x-ray beam. When the corresponding corona discharge segment 45 is actuated, the surrounding atmosphere molecules are ionized causing localised charge accumulation on the desired particle as it passes through the ionized atmosphere.

Particularly where the detection zone of any one photomultiplier tube 36 is laterally greater than the corona discharge zone produced by one discharge needle 46 (typically the corona discharge zone of one needle has a diameter of 1 cm), it is desirable to provide a plurality of laterally spaced discharge needles 46 associated with each discharge segment 45, all of which are activated together to provide a laterally spread discharge zone. Although the provision of two or more adjacent discharge needles 46 which are arranged to produce corona discharge simultaneously many cause the charging of non-selected particles at the same time as a selected particle is charged, this is considered to be preferable to not charging a selected particle because the particle is not directly in the path of the ionizing zone of a discharge segment 45 having only one needle 46.

The detecting and deflecting of the desired particles will now be described with reference to FIG. 5 in relation to a portion of the annular stream 33 of particles passing before one of the photomultiplier tubes 36 and one of the corona discharge segments 45. The particles in the portion of the stream 33 enter a detection area 47 after a vertical fall of typically 50 to 300 mm, preferably 150 mm, from the feed means 1. The detection area 47 is defined by the x-ray beam generated by the x-ray tube 34 and fluorescent response in any diamond present in the stream 33 is detected in area 47 by the photomultiplier tube 36, a signal from which, identifying the fluorescent particle, is transmitted to a discriminator 48.

When the discriminator 48 senses a fluorescent particle, the delay circuit 49 is activated by the discriminator and set so that when the chosen particle has fallen to a position level with the corona discharge means 44, which is located as close below the detection area 47 as practical, a trigger pulse from a generator 50 closes a switching circuit 51 between the corona discharge segment 45 and a positive high voltage source 52. The corona discharge segment 45 comprises a guard electrode 53 and the corona producing needle 46 which when activated creates the ionizing region. The geometry of the ionizing region and voltages are chosen so that ionization of surrounding molecules of atmosphere, usually air takes place as the switching circuit 51 is closed.

The discharge needle 46 protrudes a predetermined distance, for example 25 mm, from a brass permanent field electrode 54 which is held at a steady −10 KV potential by a high voltage supply 55. The field electrode 54 comprises an annular plate extending around the axis of the stream 33 of particles and radially within the stream. The discharge needle 46 is also located a predetermined radial distance, for example 35 mm from a brass counter electrode 56 which is held at a steady −10 KV potential by a high voltage supply 57. The electrode 56 is also of annular form extending around the axis of the stream 33 radially outwardly of said stream. The ions created when the switch circuit 51 is closed are rapidly swept to the counter electrode 56 following trajectories always perpendicular to the equipotential electrostatic field lines.

As these gaseous ions intercept the desired particle, as well as any other particles present in the ionizing region at the instant in time that the discharge is applied, the ions tend to attach electrostatically to oppositely charged sites on the surface lattice of such particle or particles. This gives the or each such particle as a whole a large net charge, the magnitude being limited after partial saturation by repulsion of further like charged gas ions moving past their surfaces. The amount of charge which can be imparted to the or each particle is believed to be limited by the breakdown of either the atmosphere or the particle but may be in the order of several thousand volts. This arrangement permits selective charging of particles many times per second and the charging may be made more or less specific by changing the amount that the or each discharge needle 46 protrudes into the ionizing region between plate electrodes 54 and 56, that is by changing how much the needle protrudes from the guard electrode 53 surrounding the needle.

Any selectively charged particle is deflected towards the counter electrode 56 as it falls and is thereby deflected radially outwardly of an annular splitter plate 58. The counter electrode 56 is angled over its lower portion at 45° to the vertical to avoid strongly deflected particles bouncing off the electrode and possibly crossing the splitter plate 58 into a reject zone radially inwardly thereof. It has been found that the electrical state of the splitter plate 58, which is located typically 80 mm vertically below the discharge needle level, is not critical, and it can conveniently be made of plastics or metal depending on wearing qualities desired. It is conceivable that a counter electrode 56 may be earthed in which case the potential of electrode 54 may be increased to say +20 KV.

In the absence of fluorescence as detected by the photomultiplier 36 and discriminator 48, a particle would pass through an essentially zero electric field between the statically biased parallel plate electrodes 54 and 56 in the stream 33 to the radially inner reject zone of the splitter plate 58.

A minor degree of induction charging may take place on particles due to non-zero electric field in the deflection region between the plate electrodes 54 and 56, but the magnitude of such effect is generally too low to appreciably change the essentially vertically downward path of the stream 33 falling under gravity. Opposed electrodes 59 and 60 may optionally be included in the apparatus as a constant ionizing source of negative polarity to precharge particles uniformly in order to mask any residual surface charge which may have been present, arising for example by triboelectric effects.

It may be found that the precharging electrodes 59 and 60 are not necessary but it may be desirable to shield particles in the discharge zone of the radial distributor 2 (which is typically at least 100 mm above the ionizing region) to avoid uncontrollable flight behaviour of particles which are attracted rather than deflected from the discharge needle 46. This may be successfully accomplished by placement of electrostatic shields to surround the feeder discharge. These electrostatic fields conveniently take the form of annular earthed brass plates 61 and 62 which screen the particles as they fall from the rim 5 of the distributor plate 3. The electrodes 61 and 62 are shown schematically in FIG. 5 but if used should closely follow the trajectory path of the particles as they are discharged from the distributor 2, with the plates 61 and 62 extending from immediately adjacent above and below, respectively, the rim 5 and carried downwardly therefrom.

Charging of the selected particles may be performed by other means such as is described with reference to FIG. 2 in our aforementioned copending application.

The apparatus described herein with reference to the drawings provides what is effectively a very wide random stream of particles in such a way that all the particles can readily be presented to the detector and deflection components and can remain within close proximity to for example, a single x-ray source target. The absence of belts and associated equipment enables the provision of a compact easily serviceable unit with easy access to the radially disposed detector and deflection modules. The design enables ease of confinement of radiation, both ambient light from getting inside and x-rays from leaking outside and the apparatus may be made extremely compact considering its throughput capacity.

Although as described herein the particles fall in a random stream which is continuous in the circumferential direction, there may be applications, particularly in high grade or final sorting operations, in which it is preferred to divide the stream of particles into separate, circumferentially spaced arcuate steams. This may be achieved by providing suitable guides such as radial corrugations or channels 4*a* or peripheral guides on the radial distributor as shown in FIG. 7.

The radial distributor may alternatively be vibrated by axially spaced eccentric weights, but this tends to cause vibration in a multi-planar sense whereas it is believed vibration in the radial plane is more satisfactory. The radial distributor may be supported from the frame or other support by spring means rather than by mountings of a resilient material.

For small particles (typically in the 1 mm size range) it is preferable that the distributor is vibrated at high frequency (typically at 50 Hz and above) to obtain an even feed distribution over the lip of the distributor and into the sorting zone. The distributor 2 described herein is particularly suited for use with sorting apparatus for detecting particles in the size range 0.5–3 mm, but it will be appreciated that it may also be used for larger particles and objects.

What we claim is:

1. Sorting apparatus comprising particle feed means capable of feeding particles to be sorted in paths which radiate out from a central zone of the apparatus and free-fall substantially vertically downwardly in an array curved about the central zone, said feed means comprising a rotationally fixed substantially horizontally extending distributor plate and vibrating means adapted to vibrate the plate in a horizontal plane, and means beneath the particle feed means to separate the particles into fractions according to the degree to which they possess a particular characteristic as they fall in said substantially vertical curved array of paths around the central zone.

2. Sorting apparatus as claimed in claim 1 in which the particle feed means comprises a source for the particles to be sorted and means capable of controlling outflow of the particles from the source and a means of feeding the particles to the distributor plate in an array substantially corresponding to said curved array.

3. Sorting apparatus as claimed in claim 1 in which the distributor plate has a generally conical upwardly facing surface and the particles are fed from the centre to the edge of said conical surface to define said curved array.

4. Sorting apparatus as claimed in claim 1 in which the curved array is cylindrical.

5. Sorting apparatus as claimed in claim 1 which includes detection means responsive to a certain characteristic of the particles moving in said paths in a curved detection zone, which is adapted to actuate the separating means to separate the particles exhibiting the certain characteristic.

6. Sorting apparatus as claimed in claim 1 in which the distributor plate is resiliently mounted on a frame of the apparatus and wherein the vibrating means comprises eccentric weight means mounted on the distributor plate for rotation relative thereto, and driving means to rotate the eccentric weight means.

7. Sorting apparatus as claimed in claim 6 in which the speed of rotation of the weight means is adjustable to vary the vibration.

8. Sorting apparatus as claimed in claim 6 in which the amount of eccentricity of the weight means is adjustable to vary the vibration.

9. Sorting apparatus as claimed in claim 6 in which the eccentric weight means is rotatively mounted within the body of the distributor plate.

10. Sorting apparatus as claimed in claim 1 in which the upper surface of the distributor plate comprises a plurality of radially extending guide means which define the paths radiating outwardly from the central zone of the apparatus.

11. A sorting method comprising feeding particles to be sorted to a feed zone of the upper surface of a substantially horizontally extending, rotationally fixed distributor plate, vibrating the distributor plate in a horizontal plane whereby the particles on said upper surface are caused to move in a single layer radially outwardly along paths from said feed zone to a curved edge of the distributor plate and fall substantially vertically from said curved edge in an array curved about the feed zone, detecting the degree to which the particles possess a certain characteristic as they fall in said curved array of paths around the feed zone, and separating the particles int fractions according to the determination of the degree to which they possess said characteristic.

* * * * *